US006401408B1

(12) United States Patent
Schwartz et al.

(10) Patent No.: US 6,401,408 B1
(45) Date of Patent: Jun. 11, 2002

(54) MOLDED PLASTIC STAKE WITH MULTIPLE SHOULDERS

(75) Inventors: Carl I. Schwartz; Richard C. Kruyer, both of Grand Blanc; Richard A. Gauthier, Marlette, all of MI (US)

(73) Assignee: Plastics Research Corporation, Flint, MI (US)

( * ) Notice: Subject to any disclaimer, the term of this patent is extended or adjusted under 35 U.S.C. 154(b) by 0 days.

(21) Appl. No.: 09/772,130

(22) Filed: Jan. 29, 2001

(51) Int. Cl.[7] ..... E02D 5/74

(52) U.S. Cl. ..... 52/155; 52/165; 52/166; 248/499; 248/500

(58) Field of Search ..... 52/165, 155, 156, 52/157, 158, 159, 166, 23, 4; 135/117, 118, 119; 248/156, 499, 500, 508, 530, 545; 256/65, 1; 403/300, 301, 362

(56) References Cited

U.S. PATENT DOCUMENTS

| | | | | |
|---|---|---|---|---|
| 427,815 | A | * | 5/1890 | Wolf |
| 442,290 | A | * | 12/1890 | Leever |
| 447,204 | A | * | 2/1891 | Rife |
| 514,922 | A | * | 2/1894 | Fulmer |
| 1,189,787 | A | * | 7/1916 | Caddy |
| D164,994 | S | | 10/1951 | Johannesen |
| 3,139,163 | A | * | 6/1964 | Haller |
| 3,342,444 | A | * | 9/1967 | Nelson |
| D218,582 | S | | 9/1970 | Kiester |
| D230,218 | S | | 1/1974 | Frelling |
| 3,788,336 | A | | 1/1974 | Steffes |
| 3,891,189 | A | * | 6/1975 | Russo |
| D243,614 | S | | 3/1977 | Russo |
| 4,185,424 | A | | 1/1980 | Streit |
| 4,455,795 | A | | 6/1984 | Cole |
| D287,098 | S | | 12/1986 | Wilson |
| 4,699,165 | A | | 10/1987 | Barzana |
| 4,801,128 | A | | 1/1989 | Taylor |
| D303,339 | S | | 9/1989 | Allen |
| 5,158,258 | A | | 10/1992 | McFadzean |
| D332,819 | S | | 1/1993 | Crowe |
| D346,036 | S | | 4/1994 | Garber |
| D359,570 | S | | 6/1995 | Garber |
| 5,524,309 | A | | 6/1996 | La Barbera |
| 5,537,768 | A | | 7/1996 | Tesselaar |
| D377,076 | S | | 12/1996 | Adams |
| D381,892 | S | | 8/1997 | Porter |
| D383,969 | S | | 9/1997 | Adams |
| 5,709,366 | A | * | 1/1998 | Speece |
| 5,809,700 | A | * | 9/1998 | Roush |
| D423,626 | S | | 4/2000 | Marino |

* cited by examiner

*Primary Examiner*—Carl D. Friedman
*Assistant Examiner*—Kevin McDermott
(74) *Attorney, Agent, or Firm*—Brooks & Kushman PC

(57) ABSTRACT

A stake having first and second generally planar members intersecting along a common longitudinal axis extending from a leading end adapted for ground penetration to a trailing end with a striking surface includes a plurality of steps toward the trailing end adapted for supporting posts of varying diameters. Support pads extend in a circumferential direction about the longitudinal axis from the steps to provide a support surface for securing a posts of varying diameters and/or shapes with a fastener. In one embodiment, the stake includes a number of holes extending through at least one of the first and second members and the first and second members include scalloped edges with a common apex at the leading end. In another embodiment, the second member includes a triangular portion with an apex displaced relative to the apex of the first member which may include a triangular or trapezoidal portion.

20 Claims, 3 Drawing Sheets

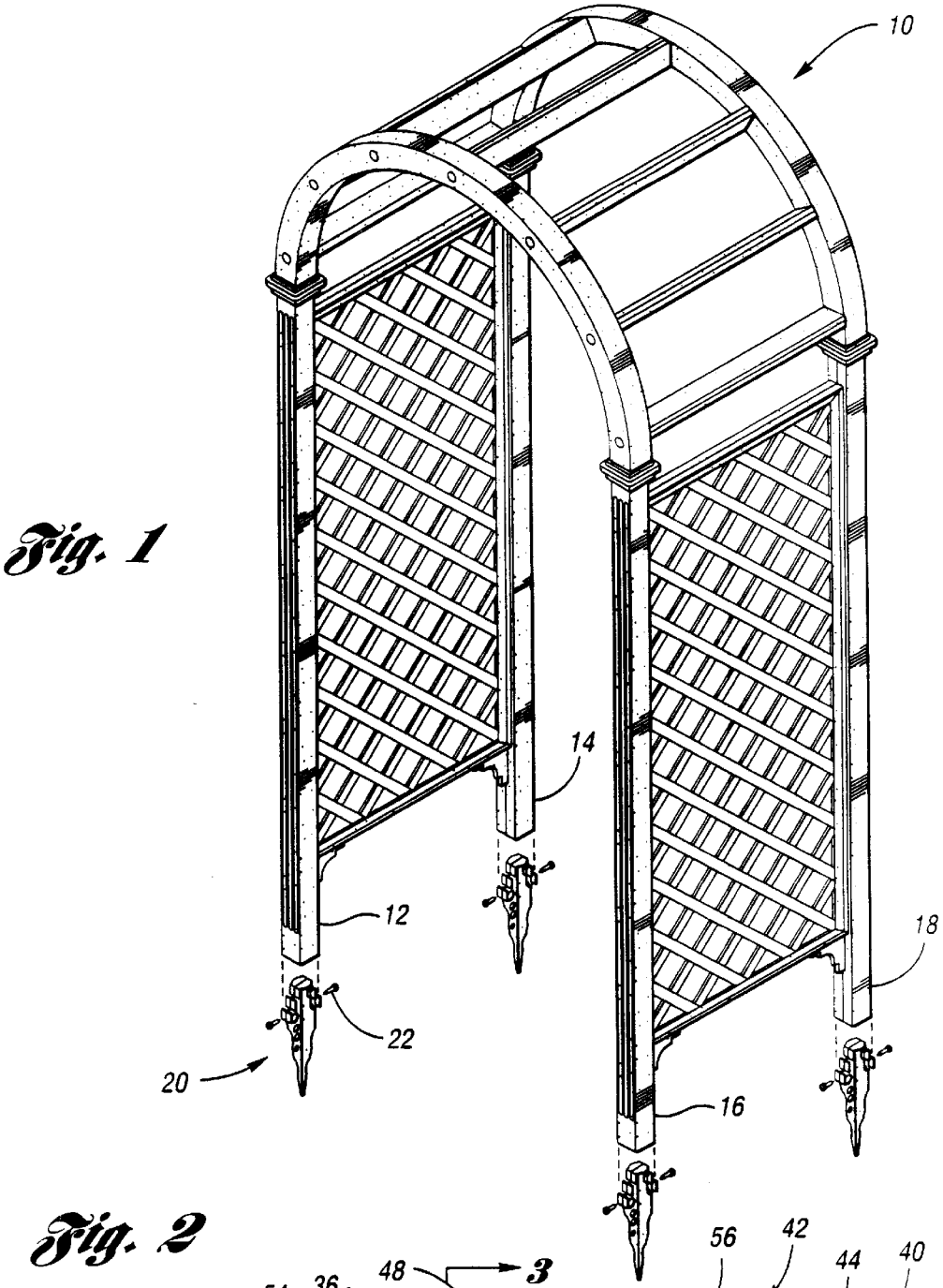
Fig. 1
Fig. 2
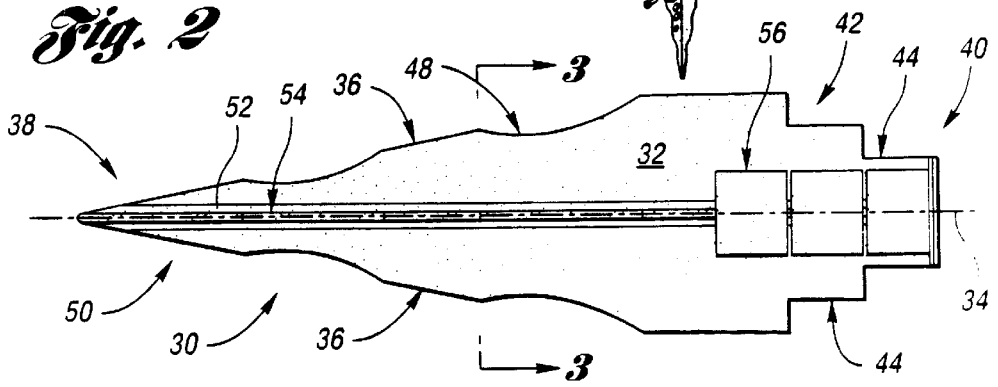

MOLDED PLASTIC STAKE WITH MULTIPLE SHOULDERS

TECHNICAL FIELD

The present invention relates to a stake with multiple shoulders for securing posts of varying shapes and/or sizes.

BACKGROUND ART

A wide variety of stakes may be found in the prior art which are used for a multitude of applications. Stakes are often used to secure objects to the ground and may include features designed for a particular object, such as a rope or post, or a particular soil type, such as sand. One application for such a stake is to secure or stabilize an object, such as an arbor, to the ground by attaching one or more arbor supports to corresponding stakes using a fastener, such as a screw. To securely fasten arbor supports of varying shapes and sizes required corresponding stakes to accommodate each type of support.

DISCLOSURE OF INVENTION

An object of the present invention is to provide a stake for securing objects of varying shapes and/or sizes to the ground.

Another object of the present invention is to provide a stake which accommodates posts of varying diameters.

A further object of the present invention is to provide a stake having multiple shoulders which may be used to secure more than one size of post or support.

Another object of the present invention is to provide a light weight, low cost stake with sufficient strength to be driven into the ground and secure objects of varying shapes and/or sizes.

Yet another object of the present invention is to provide a molded plastic stake which accommodates posts of varying diameters and provides surfaces to secure the posts to the stake.

A further object of the present invention is to provide a plastic stake with surfaces which help keep the stake planted in the ground.

In carrying out the above objects, and other objects, advantages, and features of the present invention, a stake is provided which includes at least one generally planar member having a longitudinal axis and edges tapering generally outward relative to the longitudinal axis from a leading end adapted for ground penetration toward a trailing end. The at least one planar member includes a post-supporting portion toward the trailing end having a series of steps with each step having a successively decreasing transverse dimension relative to the longitudinal axis for supporting posts of varying diameters.

In one embodiment of the present invention, a molded plastic stake for securing posts of varying diameters includes a body having a first generally planar member with a post securing portion having a striking surface and a plurality of shoulders of successively increasing diameters relative to the striking surface for supporting posts of varying diameters. The post securing portion is integrally molded with a generally trapezoidal portion having scalloped edges tapering from the post supporting portion to an apex adapted for ground penetration. The generally trapezoidal portion includes a plurality of through holes symmetrically disposed about a longitudinal axis. The first member generally perpendicularly intersects an integrally molded second generally planar member along the longitudinal axis. The second member has a post securing portion with a plurality of shoulders of successively increasing diameters relative to the striking surface for supporting posts of varying diameters and is integrally molded with a generally triangular portion having scalloped edges tapering from the post supporting portion of the second member to an apex displaced along the longitudinal axis relative to the apex of the trapezoidal portion of the first member.

In another embodiment of the present invention, a stake includes a first member having a generally triangular portion with an apex on a leading end adapted for ground penetration and a post supporting portion toward a trailing end having a first plurality of steps of successively decreasing lateral dimension arranged generally symmetrically about a longitudinal axis, a second integrally formed member intersecting the first member along the longitudinal axis which includes a generally triangular portion having an apex positioned toward the leading end of the first member and a post supporting portion having a second plurality of steps of successively decreasing diametral dimension aligned with the first plurality of steps of the first member, a generally planar striking surface integrally formed on the trailing end of the first and second members and positioned generally normal thereto, and a plurality of integrally formed post mounting surfaces extending at least partially circumferentially about the longitudinal axis from lateral edges of the steps of at least one of the first and second plurality of steps.

The present invention provides a number of advantages. For example, the present invention reduces part proliferation by providing a stake which may be used to secure multiple objects. The present invention also provides an aesthetically pleasing stake of sufficient strength to secure objects, such as arbors, to the ground. The present invention accommodates posts of varying sizes and/or shapes and provides a surface to attach the post to the stake using a fastener, if desired. The present invention includes features to reduce the amount of required material, such as through holes and scallops, which also provide benefits such as easier ground penetration and better ground retention after installation. The stepped design of the present invention facilitates installation to an appropriate depth for a particular sized post or support.

The above advantages, and other advantages, objects, and features of the present invention are readily apparent from the following detailed description of the best mode for carrying out the invention when taken in connection with the accompanying drawings. One of ordinary skill in the art will recognize that various features illustrated for one embodiment may be used alone or in combination with one or more features of other embodiments depending upon the particular application and that all contemplated combinations and permutations of features of the present invention within the scope of the claims have not necessarily been illustrated.

BRIEF DESCRIPTION OF DRAWINGS

FIG. 1 is a perspective view illustrating one application for a stake according to one embodiment of the present invention;

FIG. 2 is a side view of one embodiment for a stake according to the present invention;

BEST MODE FOR CARRYING OUT THE INVENTION

Figure 3:
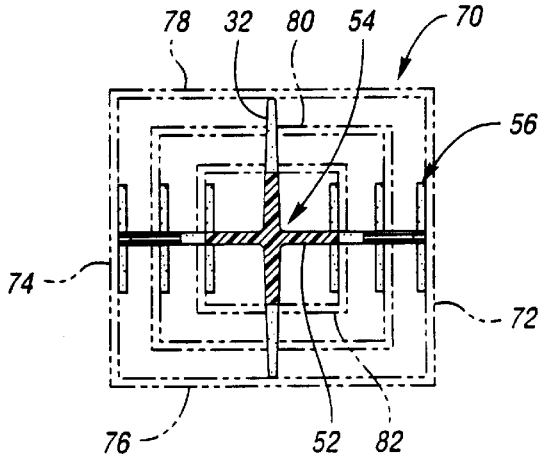
FIG. 3 is a cross-sectional view of the embodiment illustrated in FIG. 2 illustrating positioning of representative objects which may be secured by the stake according to the present invention.

FIG. 1 is a perspective view illustrating one application for a stake according to one embodiment of the present invention. As illustrated, the present invention may be used to secure a structure, such as an arbor 10, having posts 12, 14, 16, and 18 to the ground using corresponding stakes 20 and optional fasteners 22. As explained in greater detail below, stakes 20 according to the present invention include a post supporting region which is adapted to receive posts of varying diameters and/or shapes. Stakes 20 may be secured to posts 12, 14, 16, and 18 either before or after placing the stakes in the ground.

A side view of one embodiment for a stake according to the present invention is illustrated in FIG. 2. Stake 30 includes at least one generally planar member 32 having a longitudinal axis 34 and edges 36 tapering generally outward relative to longitudinal axis 34 from a leading end 38 adapted for ground penetration toward a trailing end 40. Generally planar member 32 includes a post-supporting portion, indicated generally by reference numeral 42 toward trailing end 40 which has a series of steps 44 each having a decreasing transverse dimension relative to longitudinal axis 34 for supporting posts of varying shapes and/or sizes.

In the embodiment illustrated in FIG. 2, generally planar member 32 includes a plurality of concave arcs or scallops 48 along the edges of a triangular portion 50 which is integrally formed with post-supporting portion 42. At least one additional generally planar member 52 intersects planar member 32 along longitudinal axis 34 preferably at an angle of about 90°. Depending upon the particular application, additional planar members may be aligned along common longitudinal axis 34 to provide additional support for the structure or posts secured to the post-supporting portion 42. The generally planar members 32, 52 are also preferably integrally formed. Fillets or ribs 54 may be included to provide additional strength at the intersection of the planar members as well known by those of ordinary skill in the art. In a preferred embodiment, stake 30 is an integrally formed injection molded plastic stake.

In the embodiment of FIG. 2, steps 44 on planar member 52 include support pads 56 which extend generally perpendicularly relative to corresponding edges of planar member 52 in a circumferential direction about longitudinal axis 34 and are adapted to receive a post or similar structure with at least two generally parallel opposing sides (best illustrated in FIG. 3). Of course, depending upon the particular application, additional support pads may also be provided on the steps 44 of planar member 32. Support pads 56 are preferably adapted for engagement of posts having corresponding cross-sections of varying sizes or diameters corresponding to the transverse dimension of steps 44 relative to longitudinal axis 34.

FIG. 3 is a cross-sectional view of the embodiment illustrated in FIG. 2 illustrating positioning of representative objects which may be secured by a stake according to the present invention. In this embodiment, support pads 56 are adapted for engagement with a post 70 having generally parallel opposing sides 72, 74. Depending upon the diameter of planar member 32, sides 76, 78 of post 70 may be rectangular, square, or arcuate in shape. Stake 30 according to the present invention includes a plurality of support pads 56 for varying diameters and/or shapes of posts such as represented by rectangular posts 80 and 82.

Figure 4:
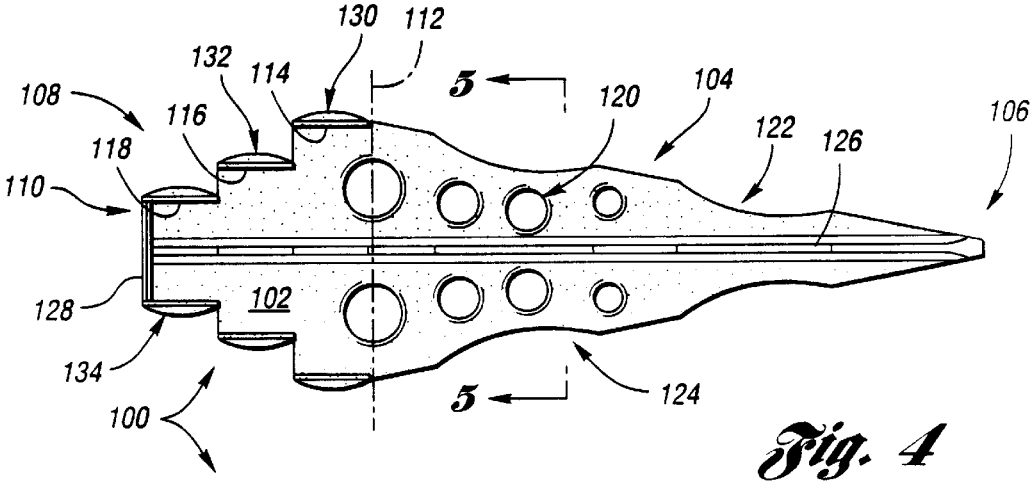
FIG. 4 is a side view of an alternative embodiment of a stake including through holes to reduce the material, reduce the weight, and improve ground retention according to the present invention.

FIG. 4 is a side view of an alternative embodiment of a stake for securing posts of varying diameters. Stake 100 includes a first member 102 having a generally triangular portion 104 with an apex toward leading end 106 which is adapted for ground penetration and a post-supporting portion 108 toward a trailing end 110 as delineated by line 112. Post-supporting portion 110 includes a plurality of steps 114, 116, 118 of successively decreasing lateral dimension arranged generally symmetrically about a longitudinal axis (not specifically shown). In this embodiment, member 102 includes a plurality of through holes 120 generally symmetrically arranged about the longitudinal axis to reduce the weight of the stake and improve ground retention after installation. Triangular portion 104 of member 102 preferably includes edges defining a plurality of concave arcs or scallops 122, 124 which may reduce the necessary insertion force and improve ground retention once the earth collapses around stake 100.

Stake 100 preferably includes a second integrally formed member 126 intersecting member 102 along the longitudinal axis. Member 126 also includes a generally triangular portion with an apex position toward leading end 106 of first member 102 and a post-supporting portion having a second plurality of steps of successively decreasing diametral dimension aligned with the first plurality of steps 114, 116, 118 of member 102. A generally planar striking surface 128 is preferably integrally formed on trailing end 110 of first member 102 and second member 126 and positioned generally normal or perpendicular thereto. First member 102 also preferably includes a plurality of integrally formed post mounting surfaces 130, 132, 134 which extend at least partially circumferentially about the longitudinal axis from the lateral edges of steps 114, 116, 118. Post mounting surfaces may also be provided on opposing steps of second member 126, depending upon the particular application. Likewise, post mounting surfaces 130 may be adapted for engagement of circular or semi-circular posts of varying diameter. Supporting surfaces 130, 132, 134 may be hemispherical as shown to facilitate placement of the posts with a slight interference fit. Alternatively, the post-supporting surfaces may be cylindrical depending upon the particular application.

Figure 5:
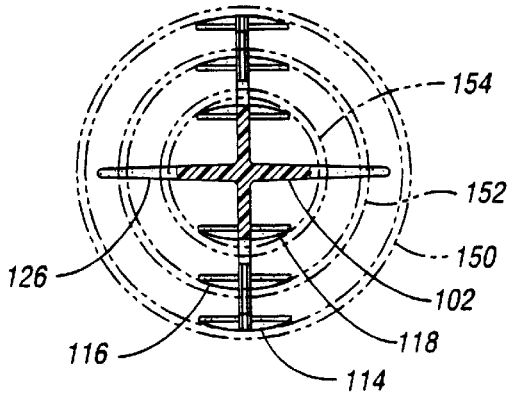
FIG. 5 is a cross-sectional view of the embodiment illustrated in FIG. 4 illustrating use of the stake with varying diameter posts or supports according to the present invention.

FIG. 5 is a cross-sectional view of the embodiment illustrated in FIG. 4 taken along the line 5—5 illustrating use of a stake with varying diameter posts or supports according to the present invention. As illustrated, post mounting surfaces 114, 116, 118 are adapted to receive circular posts of varying diameters 150, 152, and 154, respectively. As also illustrated, the steps of second member 126 need not be diametrically co-extensive with the steps of first member 102.

Figure 6A:
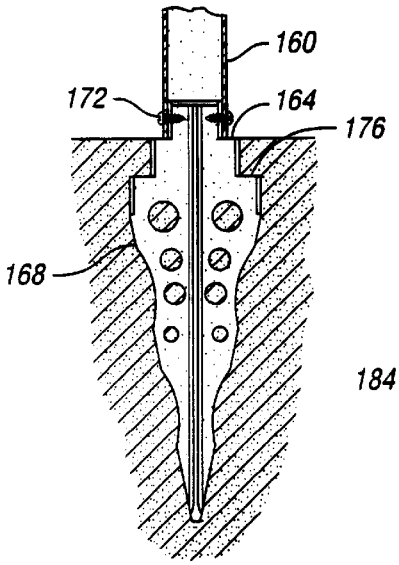
FIGS. 6*a*–6*c* are partial cross-sectional views illustrating posts of varying diameters secured to a stake and installed at varying depths according to one embodiment of the present invention.
Figure 6B:
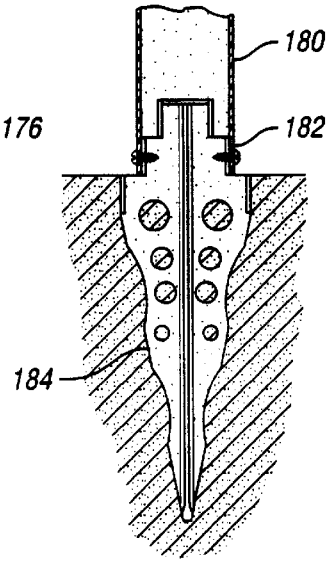
Figure 6C:
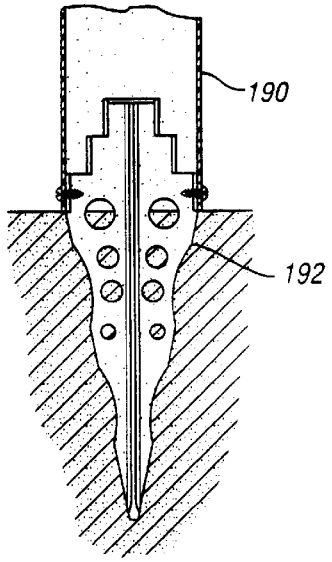

FIGS. 6*a*–6*c* are partial cross-sectional views illustrating posts of varying diameters secured to a stake and installed at varying depths according to one embodiment of the present invention. As illustrated in FIG. 6*a*, a post 160 is supported by a first step or shoulder 164 of stake 168 and may be secured by one or more optional fasteners 172. In one preferred embodiment, self-tapping screws are used to secure posts to support pads of corresponding diameter on stake 168. As illustrated, after installation in the ground, additional steps 176 of stake 168 improve ground retention as the ground fills in around them.

FIG. 6*b* illustrates a post 180 having a larger diameter than that illustrated in FIG. 6*a*. Post 180 rests on the second step or shoulder 182 of stake 184. The steps or shoulders facilitate appropriate depth placement of stake 184 prior to securing posts 180.

FIG. 6*c* illustrates a post 190 having a larger diameter in corresponding to a third pair of supports on stake 192.

Figure 7:
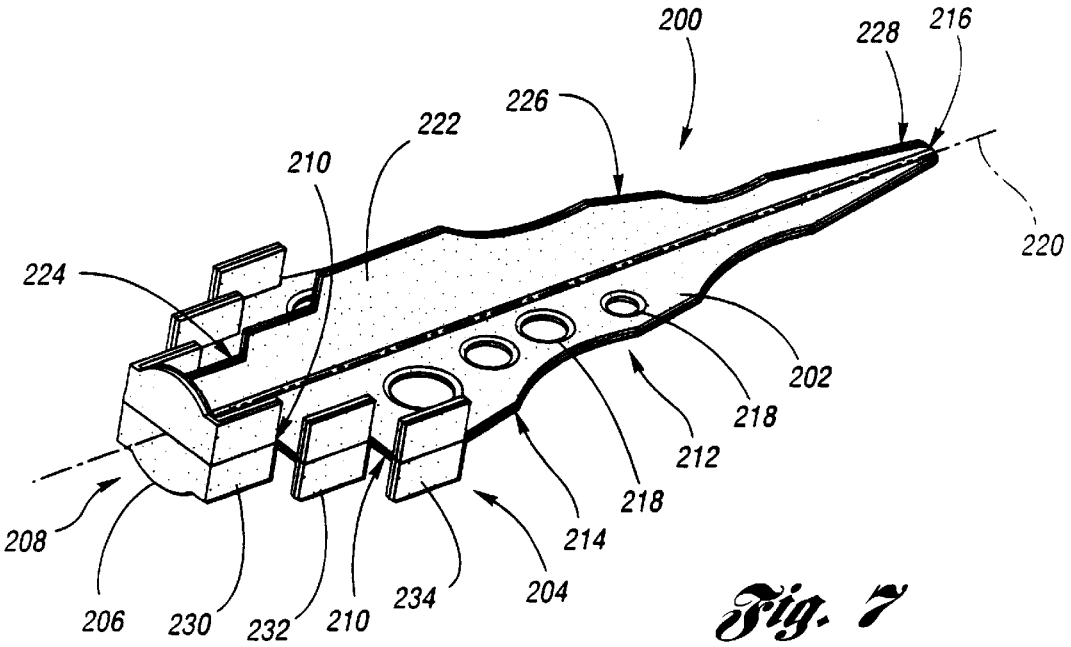
FIG. 7 is a perspective view illustrating a stake according to one embodiment of the present invention.

FIG. 7 is a perspective view illustrating a stake according to one embodiment of the present invention. Stake 200 is preferably an injection molded plastic stake for securing posts of varying diameters which includes a body having a first generally planar member 202 with a post securing portion 204 with a striking surface 206 at its trailing end. A plurality of shoulders 210 of successively increasing diameters relative to striking surface 206 are provided for supporting posts of varying diameters. Post securing portion 204 is preferably integrally molded with a generally trapezoidal portion 212 having scalloped edges 214 tapering from post-supporting portion 204 to an apex 216 adapted for ground penetration. Trapezoidal portion 212 includes a plurality of through holes 218 symmetrically disposed about a longitudinal axis 220. Generally planar member 202 approximately perpendicularly intersects an integrally molded second generally planar member 222 along longitudinal axis 220. Second member 222 includes a post securing portion 224 with a plurality of shoulders of successively increasing diameters relative to striking surface 206 for supporting posts of varying diameters. Member 222 is preferably integrally molded with a generally triangular portion 226 having scalloped edges tapering from post-supporting portion 224 to an apex 228 which is displayed along longitudinal axis 220 relative to apex 216 of member 202. Stake 200 preferably includes three pairs of integrally molded pads 230, 232, 234 which are generally perpendicularly positioned relative to lateral surfaces of the plurality of shoulders 210. Pads 230, 232, 234 include an inter surface which extends generally parallel to member 222 and an outer surface adapted for securing a post. The outer surface may be flat or rounded as illustrated in FIGS. 3 and 5, for example.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A stake comprising:

at least one generally planar member having a longitudinal axis and edges tapering generally outward relative to the longitudinal axis from a leading end adapted for ground penetration toward a trailing end, the at least one planar member including a post-supporting portion toward the trailing end having a series of steps with each step having a decreasing transverse dimension relative to the longitudinal axis for supporting posts of varying diameters.

2. The stake of claim 1 wherein the at least one generally planar member comprises a plurality of generally planar members aligned along a common longitudinal axis.

3. The stake of claim 1 wherein the at least one generally planar member comprises first and second generally planar members aligned along a common longitudinal axis intersecting at an angle of about 90 degrees.

4. The stake of claim 1 wherein the at least one generally planar member includes a plurality of through holes.

5. The stake of claim 1 wherein at least one pair of opposing steps of the series of steps includes support pads extending generally perpendicularly relative to corresponding edges of the at least one generally planar member.

6. The stake of claim 5 wherein the support pads are adapted to receive a post having a cross-section with at least two generally parallel opposing sides.

7. The stake of claim 5 wherein the support pads are adapted to receive a post having a cross-section with at least two generally circular opposing arcs.

8. The stake of claim 1 wherein the edges include at least one scallop.

9. The stake of claim 1 wherein the trailing end comprises a striking surface generally perpendicular to the at least one generally planar member and normal to the longitudinal axis.

10. A molded plastic stake comprising:

a first member having a generally triangular portion with an apex on a leading end adapted for ground penetration and a post supporting portion toward a trailing end having a first plurality of steps of successively decreasing lateral dimension arranged generally symmetrically about a longitudinal axis;

a second integrally formed member intersecting the first member along the longitudinal axis, the second member including a generally triangular portion having an apex positioned toward the leading end of the first member and a post supporting portion having a second plurality of steps of successively decreasing diametral dimension aligned with the first plurality of steps of the first member;

a generally planar striking surface integrally formed on the trailing end of the first and second members and positioned generally normal thereto; and a plurality of integrally formed post mounting surfaces extending at least partially circumferentially about the longitudinal axis from lateral edges of the steps of at least one of the first and second plurality of steps.

11. The molded plastic stake of claim 10 wherein at least one of the first and second members includes a plurality of through holes to reduce weight of the stake.

12. The molded plastic stake of claim 11 wherein the plurality of through holes are symmetrically arranged relative to the longitudinal axis.

13. The molded plastic stake of claim 10 wherein the generally triangular portion of at least one of the first and second members includes edges having a plurality of concave arcs.

14. The molded plastic stake of claim 10 wherein the plurality of integrally formed post mounting surfaces are adapted to support a rectangular post.

15. The molded plastic stake of claim 10 wherein the plurality of integrally formed post mounting surfaces are adapted to support a circular post.

16. The molded plastic stake of claim 15 wherein each of the plurality of integrally formed post mounting surfaces is defined by intersection of a sphere and a plane generally perpendicular to the first or second member.

17. The molded plastic stake of claim 10 wherein the apex of one of the first and second members is displaced along the longitudinal axis relative to the apex of the other one of the first and second members.

18. The molded plastic stake of claim 10 wherein at least one of the first and second members includes a truncated apex.

19. A molded plastic stake for securing posts of varying diameters, the stake comprising a body having a first generally planar member having a post securing portion with a striking surface and a plurality of shoulders of successively increasing diameters relative to the striking surface for supporting posts of varying diameters, the post securing portion being integrally molded with a generally trapezoidal portion having scalloped edges tapering from the post supporting portion to an apex adapted for ground penetration, the generally trapezoidal portion including a plurality of through holes symmetrically disposed about a longitudinal axis, the first member generally perpendicularly intersecting an integrally molded second generally planar member along the longitudinal axis, the second member having a post securing portion with a plurality of shoulders of successively increasing diameters relative to the striking surface for supporting posts of varying diameters and integrally molded with a generally triangular portion having scalloped edges tapering from the post supporting portion of the second member to an apex displaced along the longitudinal axis relative to the apex of the trapezoidal portion of the first member.

20. The molded plastic stake of claim 19 wherein the first member includes integrally molded pads generally perpendicularly positioned relative to lateral surfaces of the plurality of shoulders and including an inner surface extending generally parallel to the second member and an outer surface adapted for securing to a post.

* * * * *